United States Patent [19]

Inoue et al.

[11] Patent Number: 4,497,301

[45] Date of Patent: Feb. 5, 1985

[54] ELECTRONIC FUEL INJECTION CONTROL SYSTEM FOR INTERNAL COMBUSTION ENGINES, INCLUDING MEANS FOR DETECTING ENGINE OPERATING CONDITION PARAMETERS

[75] Inventors: Kazuo Inoue, Nerima; Tetsuo Yamagata, Bunkyo, both of Japan

[73] Assignee: Honda Giken Kogyo Kabushiki Kaisha, Tokyo, Japan

[21] Appl. No.: 350,360

[22] Filed: Feb. 19, 1982

[30] Foreign Application Priority Data

Feb. 20, 1981 [JP] Japan ..... 56-23175

[51] Int. Cl.[3] ..... F02M 51/00

[52] U.S. Cl. ..... 123/486; 123/478

[58] Field of Search ..... 123/478, 486, 488, 491

[56] References Cited

U.S. PATENT DOCUMENTS

| | | | |
|---|---|---|---|
| 4,310,888 | 1/1982 | Furuhashi et al. | 123/491 |
| 4,313,412 | 2/1982 | Hosaka et al. | 123/486 |
| 4,319,327 | 3/1982 | Higashiyama et al. | 123/486 |
| 4,345,561 | 8/1982 | Kondo et al. | 123/486 |
| 4,352,158 | 9/1982 | Date et al. | 123/486 |
| 4,368,705 | 1/1983 | Stevenson et al. | 123/486 |

*Primary Examiner*—Parshotam S. Lall
*Assistant Examiner*—W. R. Wolfe
*Attorney, Agent, or Firm*—Lyon & Lyon

[57] ABSTRACT

An electronic fuel injection control system for use with an internal combustion engine, which includes means for generating at least one kind of coefficient for correcting the value of basic fuel injection quantity data on the basis of output values of means for detecting engine operating condition parameters inclusive at least of engine temperature, and also includes means for setting the value of the above correction coefficient to a value corresponding to a predetermined value of an engine operating condition parameter concerned which falls within a range within which the value of the same parameter is variable during normal engine operation, when an output value of the detecting means becomes outside a range within which the same output value is variable during normal operation of the engine.

18 Claims, 11 Drawing Figures

ELECTRONIC FUEL INJECTION CONTROL SYSTEM FOR INTERNAL COMBUSTION ENGINES, INCLUDING MEANS FOR DETECTING ENGINE OPERATING CONDITION PARAMETERS

BACKGROUND OF THE INVENTION

This invention relates to an electronic fuel injection control system for use with an internal combustion engine, and more particularly to an electronic fuel injection control system which is adapted to control the quantity of fuel being injected into an internal combustion engine in dependence upon parameters representing the operating condition of the engine such as intake pressure, throttle valve opening and engine rotational speed.

Conventional electronic fuel injection control systems include a type which is adapted to determine the value of a basic fuel injection quantity on the basis of engine rotational speed, engine intake pressure and/or throttle valve opening, which are parameters representative of the volume of engine intake air.

The systems of this type include a hybrid type which is adapted to determine the value of a basic fuel injection quantity by the use of a matrix memory storing a map which is formed of parameters of engine rpm (hereinafter called "Ne") and intake pressure (hereinafter called "$P_B$") in a lower engine load region, while determining the basic fuel injection quantity value by the use of a matrix memory storing a map which is formed of parameters of Ne and throttle valve opening (hereinafter called "$\theta$th") in a higher engine load region.

As well known, an internal combustion engine can often suffer poor startability since the engine temperature (hereinafter called "Tw") is low at the start of the engine. To improve the startability, conventional fuel injection control systems employ fuel quantity correction or increase during warming-up of the engine, which comprises correcting the basic injection quantity value which has been determined in the aforementioned manner, in dependence upon the engine temperature from the start of the engine to the completion of the engine warming-up.

In a supercharged engine, the fuel injection quantity is further corrected in dependence upon the mass of intake air. That is, detection is made of the pressure P1 and temperature T1 of intake air, i.e., atmospheric air at the inlet of a compressor located upstream of a throttle valve in the intake pipe of the engine, as well as pressure P2 at a zone between the outlet of the compressor and the throttle valve. Further, the temperature of intake air at the outlet of the compressor is arithmetically determined on the basis of the detected values of the above parameters P1, T1 and P2. Correction of the injection quantity is thus carried out on the basis of the mass of the intake air, i.e., the temperature and pressure of the same thus obtained.

In a non-supercharged engine, similar intake air mass-based correction of the injection quantity is employed, using the pressure P1 and temperature T1 of the ambient atmospheric air.

In the above-mentioned conventional electronic fuel injection control systems, control of the fuel injection quantity cannot be properly performed in the event of trouble (breakage, disconnection, shorting, etc.) in the sensors for detecting the various engine operating condition parameters ($P_B$, $\theta$th, Ne, Tw, P1, T1, P2) or in the wires related to the sensors.

For instance, trouble in the engine temperature sensor for detecting the engine temperature (e.g., the temperature of engine cooling water or lubricant oil) and/or its related wiring prevents proper achievement of the aforementioned warming-up fuel quantity increase. More specifically, for instance, if the engine temperature sensor gets broken after completion of the warming-up of the engine so that its output falls in its output range which is usually assumed during warming-up operation, an excessive increase occurs in the quantity of fuel supplied to the engine, resulting in an excessively rich mixture being supplied to the engine. Further, in electronic fuel injection control systems employing the aforementioned hybrid method, the fuel injection control is not properly performed in a lower engine load region in the event of trouble in the $P_B$ sensor or its related wiring, and in a higher engine load region in the event of trouble in the $\theta$th sensor or its related wiring, respectively, which can lead to a drop in engine performance. Instead of the hybrid method, a method may be applied to such injection control systems, which comprises determining the value of basic fuel injection quantity throughout the entire engine load regions, by the use of a single matrix memory storing a map formed of parameters of $P_B$ and Ne or a map formed of parameters of $\theta$th and Ne. Even in this case, the fuel injection control systems cannot be free of the above-mentioned disadvantage in the event of trouble in the sensors for detecting these parameters or their related wiring. Further, if trouble occurs in the intake air sensor means such as the T1 sensor, the P1 sensor and the P2 sensor or their related wiring, the aforementioned intake air massbased correction cannot be properly performed or is impossible to carry out.

OBJECTS AND SUMMARY OF THE INVENTION

It is therefore a primary object of the invention to provide an electronic fuel injection control system for use with an internal combustion engine, which is capable of performing proper control of the fuel injection quantity even in the event of trouble in sensors for detecting those parameters representing the operating condition of the engine which determine the amount of correction of the basic injection quantity, and/or their related wiring.

According to the invention, an electronic fuel injection control system is provided which comprises: means for detecting values of at least two first parameters indicative of the volume of intake air being supplied to the engine; means for detecting a value of a second parameter indicative of another factor of operating condition of the engine inclusive at least of the temperature of the engine; means for generating data indicative of a basic fuel injection quantity, as a function of the output of the first parameter detecting means; means for generating a coefficient for correction of the value of the basic injection quantity data, as a function of the output of the second parameter detecting means; means for correcting the value of the basic injection quantity generated, by an amount corresponding to the value of the correction coefficient generated; means for generating an electrical control signal indicative of a desired injection quantity corresponding to corrected data obtained by the correcting means; and means for setting the value of the correction coefficient to a value corresponding to a predetermined value of the second parameter which falls within a range within which the value of second paramemter can vary so long as the engine normally operates, when the output of the second parameter detecting means has a value lying outside a range within which the same output value is variable during normal operation of the engine.

The correction coefficient generating means preferably comprises a memory having a plurality of addresses storing different values of the correction coefficient corresponding, respectively, to different output values of the second parameter detecting means, and means for selecting one of the above addresses in the memory which corresponds to an actual output value of the second parameter detecting means.

The above means for setting the correction coefficient to a value corresponding to the predetermined value of the second parameter preferably comprises means providing addresses storing the above value corresponding to the predetermined value of the second parameter in portions of an address space in the memory of the correction coefficient generating means, which portions correspond to output values of the second parameter detecting means which lie outside the aforementioned variable output range during normal operation of the engine.

The above and other objects, features and advantages of the invention will be more apparent from the ensuing detailed description taken in connection with the accompanying drawings in which:

DETAILED DESCRIPTION

Figure 1A:
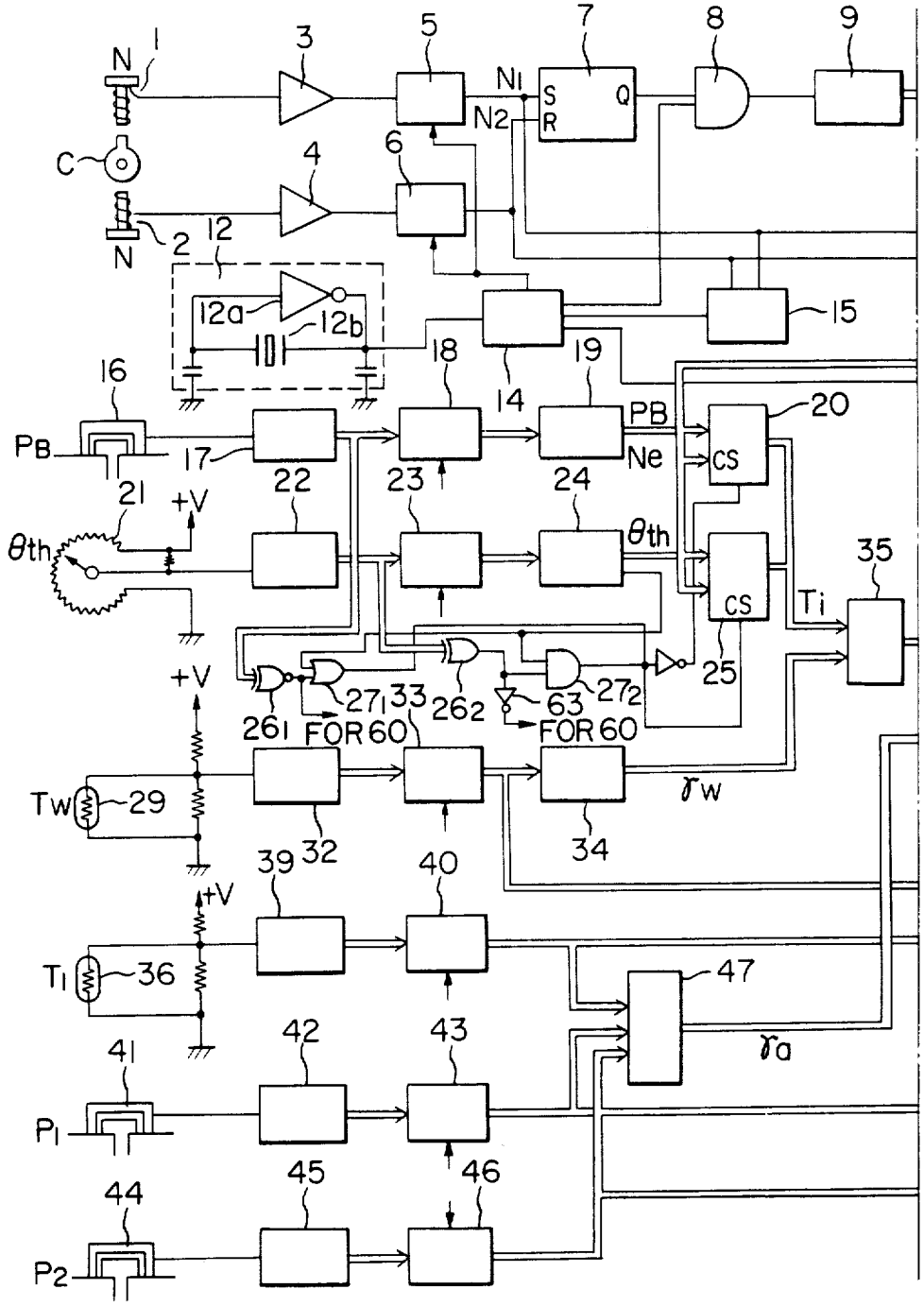
FIGS. 1A, and 1B are block diagrams illustrating an electronic fuel injection control system according to one embodiment of the invention.

The invention will now be described in detail with reference to the drawings, wherein like reference characters designate like or corresponding parts throughout all the views.

Figures 1, 1B:
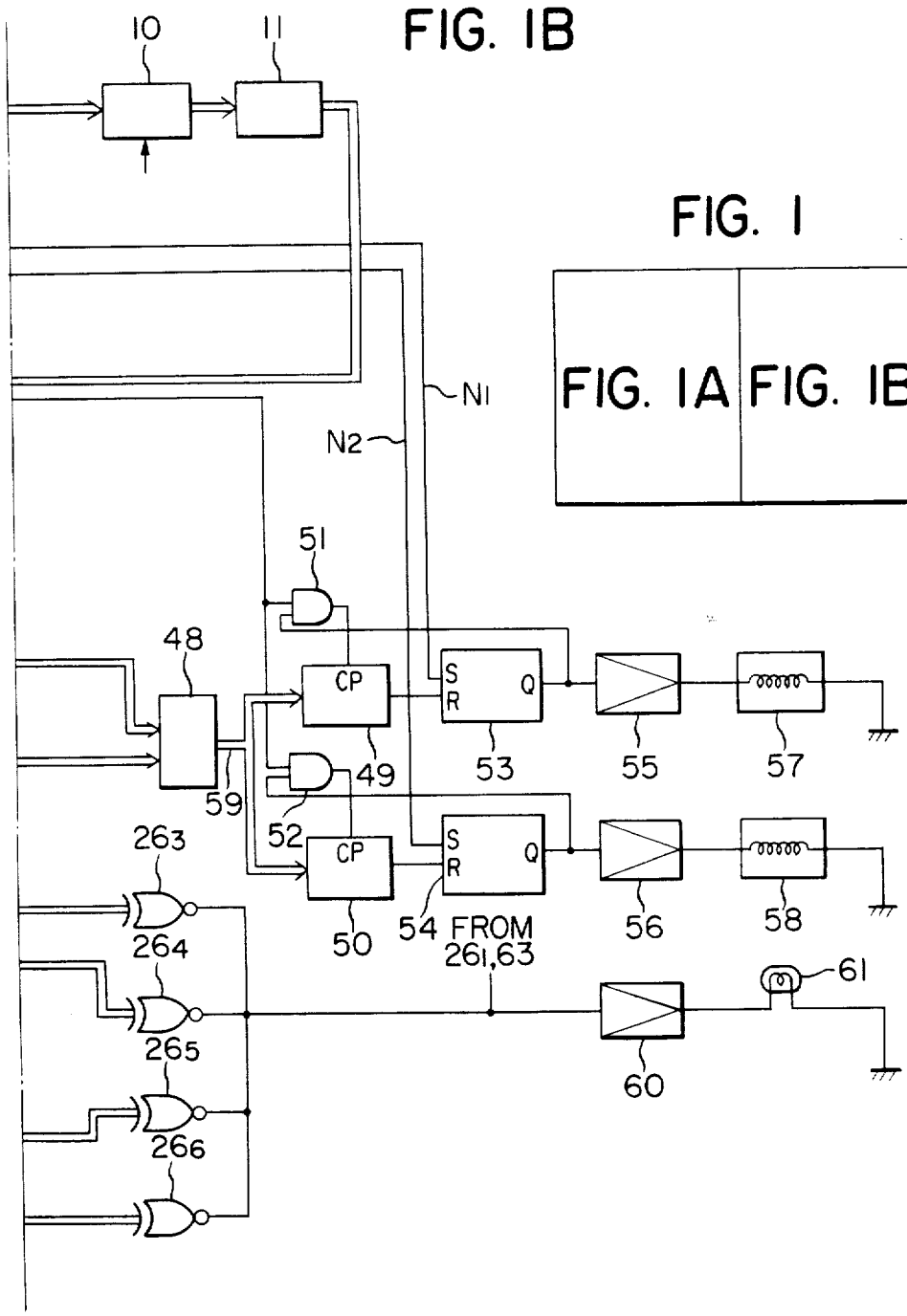

Referring first to FIG. 1, there is illustrated a block diagram of one embodiment of the invention. In FIG. 1, reference numerals 1 and 2 designate variable reluctance type shaft-rotation sensors. These sensors 1, 2 are intended to detect a reference position on a camshaft C of an engine, not shown. In the illustrated embodiment, they are arranged to generate output pulses with a phase difference of 180 degrees. The sensors 1, 2 are connected to the inputs of Schmitt trigger circuits 3, 4, respectively, which circuits in turn are connected to clock differentiation circuits 5, 6, respectively. The clock differentiation circuits 5, 6 are connected, respectively, to the set pulse-input terminal S and reset pulse-input terminal R of a flip flop 7. The flip flop 7 has its Q-output terminal connected to one input terminal of an AND gate 8 which has its output connected to a counter 9, a latch 10 and a memory 11 preferably formed of a read-only-memory (ROM) which are arranged in the mentioned order. The memory 11 stores a plurality of codes of engine rpm Ne having different values corresponding to counts which are outputted from the counter 9.

A crystal oscillator 12, which is comprised of a buffer 12*a*, a crystal resonator 12*b*, etc., is connected to the input of a frequency divider 14 which has its output connected to the clock differentiation circuits 5, 6, a timing control circuit 15 and the other input terminal of the AND circuit 8. The timing control circuit 15 is also connected to the clock differentiation circuits 5, 6 such that it is supplied with clock-differentiated outputs from the circuits 5, 6 as well as frequency-divided pulses from the frequency divider 14 and supplies a timing control signal to the latch 10, etc.

Reference numeral 16 designates a pressure ($P_B$) sensor using a diaphragm made e.g. of silicon rubber and arranged to detect pressure $P_B$ in the intake pipe, now shown, of the engine at a zone downstream of a throttle valve, not shown. The sensor 16 is connected to the input of a memory 19 formed e.g. of a read-only-memory (ROM), by way of an analog-to-digital (A/D) converter 17 and a latch 18. The memory 19 stores a plurality of codes having a plurality of different values corresponding to output values of the $P_B$ sensor 16. The memory 19 has its output connected to a matrix memory 20 formed e.g. of an ROM and storing a plurality of codes indicative of a basic injection quantity Ti, which are arranged in an Ne-$P_B$ map, having different values of the basic injection quantity as functions of combinations of parameters Ne and $P_B$.

Reference numeral 21 designates a $\theta$th sensor which can be formed e.g. of a potentiometer and is arranged to detect the opening $\theta$th of the throttle valve in the engine intake pipe. This sensor 21 is connected to a memory 24 formed e.g. of an ROM and storing a plurality of codes having different values corresponding to output values of the $\theta$th sensor 21, by way of an analog-to-digital (A/D) converter 22 and a latch 23. The output of the memory 24 is connected to a matrix memory 25 formed e.g. of an ROM which stores a plurality of codes of the basic injection quantity Ti, which are arranged in an Ne-$\theta$th map, having different values as functions of combinations of parameters Ne and $\theta$th.

Reference numeral 29 denotes a sensor formed e.g. of a thermistor and arranged to detect the temperature of engine cooling water (hereinafter called "Tw") as the engine temperature. The sensor 29 may alternatively be arranged to detect the temperature of lubricant oil used to lubricate the component parts of the engine or any other factor that may represent the temperature of the engine, in place of the engine cooling water temperature. The sensor 29 is connected through an analog-to-digital (A/D) converter 32 and a latch 33 to a memory 34 formed e.g. of an ROM and storing a plurality of codes having different values of a correction coefficient rw used to increase the injection quantity during warming-up of the engine, which values correspond to detected values of Tw.

The above-mentioned memories 20, 25, 34 are connected to a multiplier 35, hereinlater referred to.

Reference numeral 36 designates a sensor for detecting the temperature of intake air or atmospheric air temperature (hereinafter called "T1") present at the inlet of a compressor, not shown, of a turbocharger, not shown, provided in the engine. Reference numeral 41 designates a sensor for detecting the pressure of intake air present at the inlet of the compressor or atmospheric pressure (hereinafter called "P1"), and 44 a sensor comprised of a diaphragm made e.g. of silicon rubber and arranged to detect pressure (hereinafter called "P2") present in the intake pipe at a zone between the output of the compressor and the throttle valve, respectively. These sensors 36, 41, 44 are connected to a memory 47 formed e.g. of an ROM and storing a plurality of codes having different values of intake air mass-based correction coefficient ra corresponding to detected values of T1, P1 and P2, through respective ones of analog-to-digital (A/D) converters 39, 42, 45 and latches 40, 43, 46.

The multiplier 35 and the memory 47 are connected to a multiplier 48 which in turn is connected at its output to the inputs of first and second presettable counters 49, 50. The counters 49, 50 are connected at their outputs to the reset pulse-input terminals R of flip flops 53, 54. The flip flops 53, 54 have their Q-output terminals connected to first and second solenoids 57, 58 of fuel injection valves mounted in the heads of engine cylinders, not shown, respectively, through respective power amplifiers 55, 56. The set pulse-input terminals S of the flip flops 53, 54 are connected to the outputs of the clock differentiation circuits 5, 6, respectively.

On the other hand, the frequency divider 14 is further connected at its output to input terminals of AND gates 51, 52 which have their other input terminals connected to the Q-output terminals of respective flip flops 53, 54 and their outputs to the clock pulse-input terminals CP of respective presettable counters 49, 50, respectively.

Connected to the output of the A/D converter 17 connected to the $P_B$ sensor 16 is an exclusive NOR gate $26_1$ which has its output connected to the input of an OR gate $27_1$ and the input of an amplifier 60 connected to an alarm lamp 61 provided as alarm means. The input of the OR gate $27_1$ is also connected to the output of the memory 24. Connected to the output of the A/D converter 22 connected to the θth sensor 21 is an exclusive OR gate $26_2$ which has its output connected to the input of an AND gate $27_2$ as well as the input of the above amplifier 60 by way of an inverter 63. The outputs of the OR gate $27_1$ and the AND gate $27_2$ are connected to the CS terminal of the ROM 25 and also connected to the CS terminal of the ROM 20 by way of an inverter 28.

On the other hand, connected, respectively, to the outputs of the latches 33, 40, 43, 46 which temperarily store respective detected values of TW, T1, P1, P2 are the inputs of exclusive NOR circuits $26_3$, $26_4$, $26_5$, $26_6$ which in turn have their outputs connected to the input of the amplifier 60.

The operation of the arrangement of FIG. 1 described above will now be explained. The first and second shaft-rotation sensors 1, 2 detect the reference position of the cam shaft C and supply pulses with a phase difference of 180 degrees to the respective Schmitt trigger circuits 3, 4 where the pulses are subjected to waveform shaping. The shaped pulses are applied to the clock differentiation circuits 5, 6 which differntiate them and produce respective trigger pulses N1, N2 in synchronism with the leading edges (or trailing edges) of the input pulses.

The flip flop 7 is set by each trigger pulse N1 and resetted by each trigger pulse N2. When set, the flip flop 7 generates an output "1" through its Q-output terminal and applies it to the AND gate 8. On the other hand, output pulses of the crystal oscillator 12 are divided in frequency by the frequency divider 14 and the resulting frequency-divided clock pulses are also applied to the AND gate 8. Thus, the clock pulses pass through the AND gate 8 and applied to the counter 9 so that the counter 9 counts the number of the clock pulses applied thereto as long as the AND gate 8 is supplied with the Q output "1".

Thus, the count in the counter 9 corresponds to the difference in timing between trigger pulses N1 and N2, i.e., the engine rpm. The count produced by the counter 9 is temporarily stored in the latch 10. An address in the memory 11 is selected which corresponds to the value of the count so that an engine rpm code (NE) corresponding to the detected value of engine rpm Ne represented by the above count is read from the memory 11. In this embodiment, the engine rpm codes (NE) are each represented in 8 bits.

The engine intake pressure $P_B$ is detected by the $P_B$ sensor which outputs a detected output in the form of an analog value to the A/D converter 17 which in turn converts the analog value into a corresponding digital value. Since the $P_B$ value can vary during one rotational stroke of the engine, the above digital value is temporarily stored in the latch 18 in synchronism with each pulse N1 and/or each pulse N2 during each rotational stroke of the engine for stable control operation.

An address in the memory 19 is selected in dependence upon the $P_B$ value detected and latched so that a $P_B$ code corresponding to the same $P_B$ value is read from the memory 19. In this embodiment, the $P_B$ codes are each represented in 8 bits.

The 8-bit codes indicative of detected Ne, $P_B$ read from the memories 11, 19 are applied to the memory 20 in which an address is selected which corresponds to the combination of the two input codes so that a pulse width code indicative of a basic injection quantity T1 is read from the memory 20 which corresponds to the above combination of the two input codes.

The throttle valve opening θth is detected by the θth sensor 21 which outputs a detected analog value to the A/D converter 22 which changes the input detected analog value into a corresponding digital value. The resulting digital value is temporarily stored in the latch 23 in synchronism with each pulse N1 and/or each pulse N2 for prevention of fluctuations in the data value during address selecting operation.

An address in the memory 24 is selected in dependence upon the θth value detected and latched so that a θth code corresponding to the same θth value is read from the memory 24. In this embodiment, also the θth codes are each represented in 8 bits. Of the 8 bits, the 7 bits in the lower places represent a detected θth value and are used together with the above 8 bits representing a detected Ne value, for selection of an address in the memory 25. Thus read from the memory 25 is a pulse width code indicative of a basic injection quantity Ti corresponding to the combination of the two Ne and θth codes.

Of the 8 bits representing a detected θth value, the MSB (the most significant bit) is used to determine whether the Ne-$P_B$ map in the memory 20 or the Ne-θth map in the memory 25 should be used to read out a pulse width code indicative of a basic injection quantity Ti.

More specifically, the MSB of a θth value-indicative 8 bit code selected from the memory 24 is applied to the CS terminal of the memory 25 through the OR gate $27_1$ or AND gate $27_2$ and also applied to the CS terminal of the memory 20 through the OR gate $27_1$ or the AND gate $27_2$, and through the inverter 28. Therefore, when the MSB of a θth value-indicative 8 bit code has a value of 0, that is, a detected θth value is less than a predetermined value (i.e., when the engine is in a low load condition), data is read from the memory 20 and transferred to the multiplier 35, while when the MSB has a value of 1, that is, the detected θth value is larger than the predetermined value (i.e., when the engine is in a high load condition), data is read from the memory 25 and transferred to the multiplier 35.

The Tw sensor 29 detects the temperature of engine cooling water and outputs a detected analog value to the A/D converter 32 which converts the analog value into a corresponding digital value. The digital value is then temporarily stored in the latch 33 in synchronism with each pulse N1 and/or each pulse N2 for prevention of fluctuations in the value of data during address selecting operation.

Addressing of the memory 34 is carried out in dependence upon the Tw value detected and latched in the latch 33 so that an 8 bit code of correction coefficient rw for warming-up fuel increase is read from the memory 34. The 8 bit code thus read is transferred to the multiplier 35 where it is multiplied by a pulse width code of basic injection quantity Ti read from the memory 20 or the memory 25. The resulting product, i.e., a pulse width code indicative of the rw-corrected injection quantity (also represented in 8 bits) is outputted from the multiplier 35.

The intake air temperature T1 is detected by the T1 sensor 36 and the resulting detected analog value is converted into a corresponding digital value by the A/D converter 39, which is then temporarily stored in the latch 40 in the same manner and for the same purpose as in the processing of detected values of θth and Tw previously mentioned. In this embodiment, the T1 digital value is represented in 4 bits.

Atmospheric pressure P1 is detected by the P1 sensor and the resulting detected analog value is converted into a corresponding digital value by the A/D converter 42. The digital value is also temporarily stored in the latch 43 in the same manner and for the same purpose as in the processing of detected values of θth and Tw previously mentioned. In this embodiment, the P1 digital value is represented in 6 bits.

The P2 sensor 44 detects the air pressure present in the intake pipe at a zone between the outlet of the compressor and the throttle valve in a supercharged engine equipped with a turbocharger, that is, the pressure P2 of compressed air. The resulting detected analog value is converted into a corresponding digital value by the A/D converter 45 and the digital value is then temporarily stored in the latch 46 in the same manner and for the same purpose as in the processing of detected values of Tw, T1 and P1. In this embodiment, the P2 digital value is represented in 6 bits.

Addressing of the memory 47 is carried out in dependence upon digital values of intake air temperature T1, atmospheric pressure P1 and compressed air pressure P2 to have a code of intake air mass-based correction coefficient ra read from the memory 47. The code of correction coefficient ra thus read is transferred to the multiplier 48 where it is multiplied by a product rw×Ti outputted from the multiplier 35. Thus, an output code 59 indicative of a desired injection pulse width (rw×ra×Ti) subjected to both warming-up fuel increase correction and intake air mass-based correction is outputted from the multiplier 48. This output code 59 is represented in 8 bits.

The output code 59 of a desired injection pulse width is applied to the presettable counters 49, 50. At the same time, the flip flops 53, 54 are set, respectively, by pulses N1 and N2. The resulting Q outputs of the flip flops 53, 54 are supplied to the respective amplifiers 55, 56 which in turn energize the respective solenoids 57, 58 for initiation of fuel injection.

On the other hand, the same Q outputs of the flip flops 53, 54 applied to the respective AND gates 51, 52 to allow them to pass therethrough clock pulses from the frequency divider 14 to the respective counters 49, 50. Each time each clock pulse is applied to the presettable counter 49, 50, the preset value indicative of the output code 59 in the counter 49, 50 is counted down by one. Upon the count in the counter 49, 50 becoming zero, the counter 49, 50 generates a borrow signal to reset the flip flop 53, 54. The resulting Q output "0" of the flip flop 53, 54 causes deenergization of the solenoid 57, 58 to terminate fuel injection.

In the above manner, proper fuel supply control is performed in dependence upon the values of Ne, $P_B$, θth, Tw, T1, P1 and P2.

Figure 2:
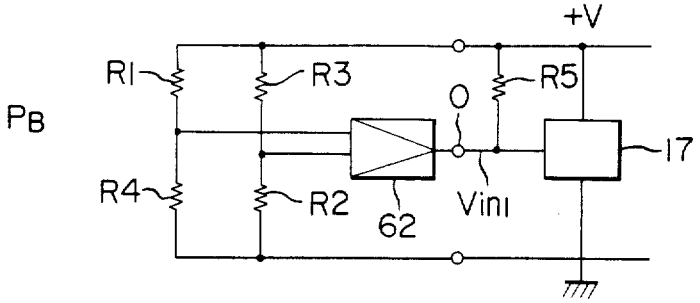
FIG. 2 is a circuit diagram illustrating details of the connection of the intake pressure ($P_B$) sensor shown in FIG. 1 with its associated parts.

Referring next to FIG. 2, there is illustrated a concrete example of the connection of the silicon diaphragm type $P_B$ sensor 16. Symbols R1, R2 designate resistances mounted on the silicon rubber diaphragm, not shown, of the $P_B$ sensor 16 and disposed to have their resistance values variable as the diaphragm becomes deformed (warped) with a change in the intake pressure $P_B$. Symbols R3, R4 designate fixed resistances. As shown in FIG. 2, the resistances R1–R4 are arranged to form a bridge circuit and supply an unbalance voltage to a differential amplifier 62. A fixed resistance R5 is connected between the positive voltage power source +V and the output of the differential amplifier 62 and has its resistance value selected such that in the event of a disconnection in the earthing conductor the input voltage Vin applied to the A/D converter 17 is higher than the highest voltage within a variable range of the output voltage of the sensor 16 available when the sensor is normally operative.

As noted above, the bridge circuit formed by the resistances R1–R4 outputs its unbalance voltage to the differential amplifier 62 which in turn supplies an output as a detected $P_B$ value to the A/D converter 17.

The A/D converter 17 has an output characteristic relative to the output of the $P_B$ sensor 16 such that its digital output does not show a value of $OO_{16}$ or $FF_{16}$ so long as the output voltage of the $P_B$ sensor remains within its normally variable range, and when an abnormality occurs in the $P_B$ sensor, the digital output assumes the above value $OO_{16}$ or $FF_{16}$ in the following manner:

(1) In the event of a disconnection in the output line from positive voltage power source +V, the input voltage $Vin_1$ to the A/D converter 17 becomes zero volt so that the digital output of the A/D converter 17 becomes $OO_{16}$;

(2) In the event of a disconnection in the earthing conductor, the input voltage $Vin_1$ rises above its normally variable range so that the digital output of the A/D converter becomes $FF_{16}$;

(3) In the event of a disconnection in the input line to the A/D converter 17, the digital output becomes $FF_{16}$;

(4) In the event of a short between the input line to the A/D converter and the earthing conductor, the input voltage $Vin_1$ becomes zero volt so that the digital output becomes $OO_{16}$;

(5) In the event of a short between the input line to the A/D converter 17 and the positive voltage power source +V, the input voltage $Vin_1$ rises up to the supply voltage so that the digital output becomes $FF_{16}$.

Since the A/D converter 17 is arranged to apply all output bits to the exclusive NOR gate $\mathbf{26_1}$ as illustrated in FIG. 1, the exclusive NOR gate $\mathbf{26_1}$ generates an output "1" when all the output bits of the A/D converter 17 assume a value "1" (that is, $FF_{16}$) or a value "0" (that is, $OO_{16}$). The above output "1" of the exclusive NOR gate $\mathbf{26_1}$ is applied to the OR gate $\mathbf{27_1}$.

When the exclusive NOR gate $\mathbf{26_1}$ generates an output "0", that is, the output value of the $P_B$ sensor 16 remains within its normally variable range, the aforementioned control operation is not affected at all.

However, when the output value of the $P_B$ sensor 16 becomes out of its normally variable range into $OO_{16}$ or $FF_{16}$, the output value of the exclusive NOR gate $\mathbf{26_1}$ becomes "1", as noted above. This output "1" is applied to the CS terminal of the memory 25 through the OR gate $\mathbf{27_1}$ and also to the CS terminal of the memory 20 through the OR gate $\mathbf{27_1}$ and the inverter 28.

Thus, the output of 1 of the exclusive NOR gate $\mathbf{26_1}$ causes data in the memory 25 to be read out, without fail. At the same time, the output "1" of the exclusive NOR gate $\mathbf{26_1}$ is applied to the amplifier 60 which turns the alarm lamp 61 on with its amplified output. The alarm means 61 may be alarm sound generating means.

Figure 3:
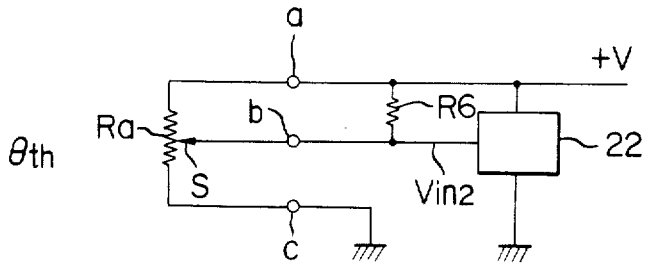
FIG. 3 is a circuit diagram illustrating details of the connection of the throttle valve opening ($\theta$th) sensor shown in FIG. 1 with its associated parts.

FIG. 3 illustrates a concrete example of the connection of the potentiometer type θth sensor 21. Symbol Ra designates a potentiometer which has a slider S arranged to be slided along a resistance body in response to a change in the throttle valve opening and connected to the input of the A/D converter 22. A fixed resistance R6 is connected between the positive voltage power source +V and the input of the A/D converter 22 and has a resistance value much larger than the whole resistance value of the potentiometer Ra (for instance, about $10^3$ times as larger as the latter).

The output characteristic of the A/D converter 22 relative to the output of the θth sensor 21 is such that its digital output does not assume a value $OO_{16}$ so long as the slider S moves within its normally movable range during normal operation of the engine. Upon occurrence of an abnormality in the θth sensor, the digital output of the A/D converter becomes $OO_{16}$ or $FF_{16}$ in the following manner:

(1) When the circuit opens at point a, the input voltage $Vin_2$ to the A/D converter 22 becomes zero volt so that the digital output of the A/D converter 22 becomes $OO_{16}$;

(2) When the circuit opens at point b, the above input voltage $Vin_2$ becomes equal to the supply voltage +V so that the digital output becomes $FF_{16}$;

(3) When the circuit opens at point c, the input voltage $Vin_2$ becomes equal to the supply voltage +V so that the digital output becomes $FF_{16}$;

(4) In the event of a short between the point a and the point b, the input voltage Vin becomes equal to the supply voltage +V so that the digital output becomes $FF_{16}$;

(5) In the event of a short between the point b and the point c, the input voltage $Vin_2$ becomes zero volt so that the digital output becomes $OO_{16}$.

Since the A/D converter 22 is arranged to apply all output bits to the exclusive OR gate $\mathbf{26_2}$ as shown in FIG. 1, the exclusive OR gate $\mathbf{26_2}$ generates an output "0" when all the output bits of the A/D converter 22 become "1" (that is, $FF_{16}$) or "0" (that is, $OO_{16}$). This output "0" of the exclusive OR gate $\mathbf{26_2}$ is applied to the AND gate $\mathbf{27_2}$.

When the exclusive OR gate $\mathbf{26_2}$ generates an output "1", that is, the output of the θth sensor 21 remains within its normally variable range, the aforementioned control operation is not affected at all.

However, when the output of the θth sensor 21 becomes $OO_{16}$ or $FF_{16}$ out of its normally variable range, the exclusive OR gate generates an output "0" as previously noted. Consequently, the CS terminal of the memory 25 is supplied with an input "0", and simultaneously the CS terminal of the memory 20 with an input "1", respectively. Therefore, when the output of the exclusive OR gate $\mathbf{26_2}$ is 0, data is read from the memory 20 without fail. At the same time, the above output "0" of the exclusive OR gate $\mathbf{26_2}$ is applied to the amplifier 60 via the inverter 63 which in turn applies an amplified output to the alarm lamp 61 to energize the same.

Advantageously, basic injection quantity pulse width data which are stored in portions of the Ne-$P_B$ map corresponding to portions of the Ne-θth map used for fuel injection quantity control during normal operation should have values somewhat larger than those stored in the Ne-θth map. This can prevent occurrence of engine trouble such as engine knocking which would otherwise be caused by a too large air/fuel ratio of the mixture.

Although the foregoing description has been made as applied to an electronic fuel injection control system of the hybrid type, obviously the present invention may be applied to a type in which a θth sensor alone is used during normal operation, utilizing basic injection quantity data stored in an Ne-θth map. In such case, an Ne-$P_B$ map should also be provided beforehand so that upon detection of an abnormality in the θth sensor operation based upon the Ne-θth map is switched over to one based upon the Ne-$P_B$ map.

Figure 4:
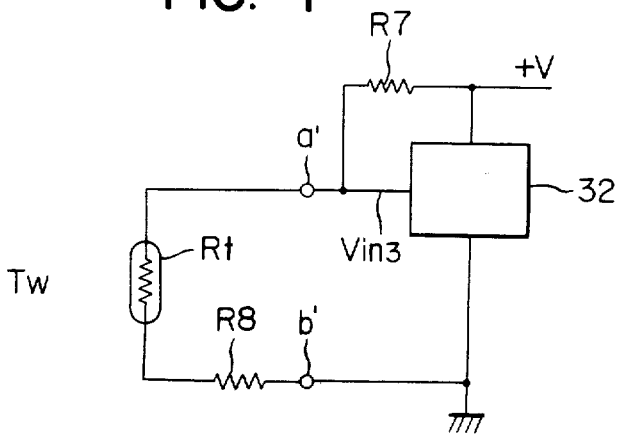
FIG. 4 is a circuit diagram illustrating details of the connection of the engine temperature (Tw) sensor shown in FIG. 1 with its associated parts.

Referring to FIG. 4, there is illustrated a concrete example of the connection of the thermistor-type Tw sensor 29 used as the engine temperature sensor. Symbol Rt denotes a thermistor which is connected in series to fixed resistances R7, R8. The junction of the thermistor Rt with the resistance R7 connected to the positive voltage power source +V is connected to the input of the A/D converter 32. Since the thermistor Rt has its resistance value variable with changes in its temperature, changes in the engine temperature cause corresponding changes in the potential at the above junction which is an input voltage to the A/D converter 32.

The output characteristic of the A/D converter 32 relative to the output of the Tw sensor 29 is such that its digital output does not become $OO_{16}$ or $FF_{16}$ so long as the engine temperature remains within its normally variable range during normal operation of the engine. In the event of an abnormality in the Tw sensor, the digital output of the A/D converter becomes $OO_{16}$ or $FF_{16}$ as follows:

(1) When the circuit opens at point a', the input voltage $Vin_3$ to the A/D converter 32 rises up to the supply voltage +V so that the digital output of the A/D converter 32 becomes $FF_{16}$;

(2) When the circuit opens at point b', the input voltage $Vin_3$ to the A/D converter 32 rises up to the supply voltage +V so that the digital output becomes $FF_{16}$;

(3) When the point a' is shorted to the ground, the input voltage $Vin_3$ to the A/D converter 32 lowers to zero volt so that the digital output becomes $OO_{16}$.

On the other hand, the addresses in the memory 34 corresponding to the digital output values $OO_{16}$ and $FF_{16}$ of the A/D converter 32 store a predetermined value of the warming-up correction coefficient rw which corresponds to a predetermined output of the engine temperature sensor (the cooling water temperature sensor 29 in this embodiment) falling within the normally variable output range of the sensor 29 available during normal warmed-up operation of the engine. Practically, the above predetermined value of correction coefficient rw should preferably be 1.

With the above arrangement, in the event of trouble in the Tw sensor 29 as mentioned above, fuel injection control is carried out which is similar to that available during warmed-up operation of the engine, thus avoiding the disadvantage that a too rich mixture is supplied to the engine to deteriorate the emission characteristics of the engine and increase the fuel consumption.

Further, since all the output bits of the A/D converter 32 are inputted to the exclusive NOR gate $26_3$ through the latch 33 as illustrated in FIG. 1, the exclusive NOR gate $26_3$ generates an output "1" when all the output bits of the A/D converter 32 have a level "1" (that is, $FF_{16}$) or a level "0" (that is, $OO_{16}$). The above output "1" of the exclusive NOR gate $26_3$ actuates the amplifier 60 to energize the alarm lamp 61.

Figure 5:
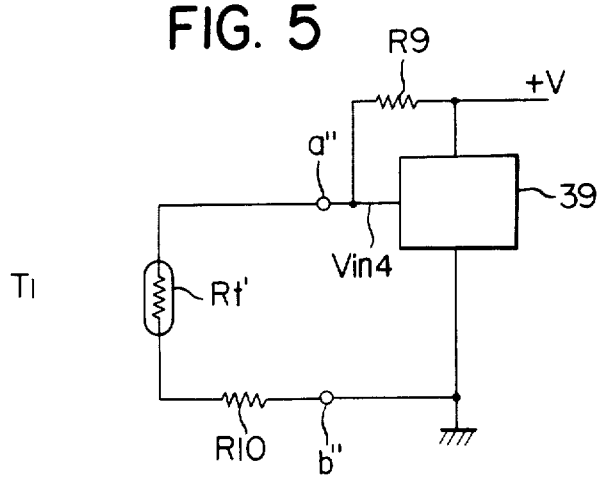
FIG. 5 is a circuit diagram illustrating details of the connection of the intake air temperature (T1) sensor shown in FIG. 1 with its associated parts.

Referring to FIG. 5, there is illustrated a concrete example of the connection of the thermistor-type intake air temperature T1 sensor 36. Symbol Rt' designates a thermistor which is connected to fixed resistances R9, R10 in series. The junction of the thermistor Rt' with the resistance R9 connected to the positive voltage power source +V is connected to the input of the A/D converter 39.

The output characteristic of the A/D converter 39 relative to the output of the sensor 36 is set such that its digital output does not become $OO_{16}$ or $FF_{16}$ so long as the sensor output remains within its normal variable range during normal operation of the engine. In the event of an abnormality in the T1 sensor, the digital output of the A/D converter 39 becomes $OO_{16}$ or $FF_{16}$ in the following manner:

(1) When the circuit opens at point a'', the input voltage $Vin_4$ to the A/D converter 39 rises up to the supply voltage +V so that its digital output becomes $FF_{16}$;

(2) When the circuit opens at point b'', the input voltage $Vin_4$ to the A/D converter rises up to the supply voltage so that its digital output becomes $FF_{16}$;

(3) When the point a'' is shorted to the ground, the input voltage $Vin_4$ to the A/D converter drops to zero volt so that its digital output becomes $OO_{16}$.

On the other hand, the addresses in the memory 47 corresponding to the digital output values $OO_{16}$ and $FF_{16}$ of the A/D converter 39 store a predetermined value $ra_1$ of intake air mass-based correction coefficient ra which corresponds to a particular temperature (e.g. 25° C.) falling within the normally variable range of the T1 value available during normal operation of the engine. Therefore, in the event of trouble in the T1 sensor as mentioned above, fuel injection control is carried out which is similar to that available when the atmospheric air temperature is equal to the above particular temperature (e.g. 25° C.), thus allowing the engine to normally operate. The above predetermined value $ra_1$ may be set at 1 so that in the event of sensor trouble the intake air mass-based fuel quantity correction is automatically interrupted.

Since all the output bits of the A/D converter 39 are inputted to the exclusive NOR gate $26_4$ via the latch 40 as illustrated in FIG. 1, the output of the exclusive NOR gate $26_4$ becomes "1" when all the output bits of the A/D converter 39 are "1" (that is, $FF_{16}$) or "0" (that is, $OO_{16}$), the above output "1" being used to energize the alarm lamp 61 as in the preceding examples.

Figure 6:
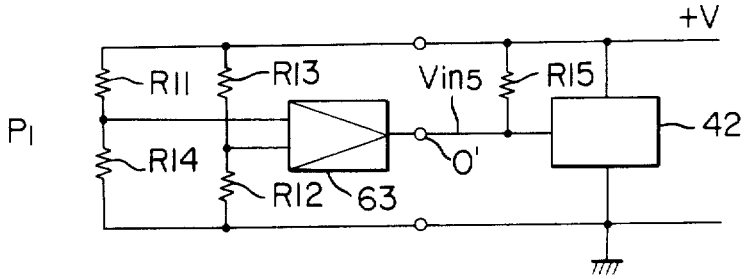
FIG. 6 is a circuit diagram illustrating details of the connection of the atmospheric pressure (P1) sensor shown in FIG. 1 with its associated parts.

FIG. 6 illustrates a concrete example of the silicon diaphragm-type P1 sensor 41. Symbols R11, R12 designate resistances mounted on the silicon diaphragm, not shown, of the sensor 41 in such a manner that their resistance values vary as the silicon diaphragm becomes deformed (warped) with a change in atmospheric pressure or in the internal pressure P1 in the air cleaner of the engine. Symbols R13, R14 are fixed resistances. As shown in FIG. 6, these resistances R11–R14 are arranged to form a bridge circuit. A further fixed resistance R15 is connected between the positive voltage power supply +V and the input of the A/D converter 42 and has its resistance value selected such that the input voltage to the A/D converter 42 takes a value larger than any value falling within the normally variable output range of the P1 sensor, when there occurs a disconnection in the earthing conductor.

The above bridge circuit R11–R14 is connected to the input of a differential amplifier 63 to supply the same with an unbalance voltage, which amplifier is arranged to apply its output indicative of a detected P1 value to the A/D converter 42. The output characteristic of the A/D converter 42 relative to the output of the P1 sensor 41 is set such that its digital output does not become $OO_{16}$ or $FF_{16}$ so long as the output of the P1 sensor remains within its normally variable output range during normal operation of the engine. In the event of the following defects in the P1 sensor, the digital output of the A/D converter becomes $OO_{16}$ or $FF_{16}$:

(1) In the event of a disconnection in the output line from the positive voltage power source +V, the input voltage $Vin_5$ drops to zero volt so that the digital output of the A/D converter 42 becomes $OO_{16}$;

(2) In the event of a disconnection in the earthing conductor, the input voltage $Vin_5$ rises above its normally variable range so that the digital output becomes $FF_{16}$;

(3) In the event of a disconnection in the input line (at point o') to the A/D converter 42, the digital output becomes $FF_{16}$;

(4) In the event of a short between the input line to the A/D converter and the earthing conductor, the input voltage $Vin_5$ becomes zero volt so that the digital output becomes $OO_{16}$;

(5) In the event of a short between the input line to the A/D converter 42 and the positive voltage power source +V, the input voltage $Vin_5$ rises up to the supply voltage so that the digital output becomes $FF_{16}$.

The addresses in the memory 47 corresponding to the digital outputs $OO_{16}$ and $FF_{16}$ of the A/D converter 42 store a predetermined value $ra_2$ of the intake air mass-based correction coefficient ra which corresponds to a particular pressure (e.g. 760 mmHg) falling within the normally variable range of the P1 value. The above predetermined coefficient value $ra_2$ may of course be set at 1. Therefore, in the event of trouble in the P1 sensor as mentioned above, fuel injection control is carried out which is similar to that available when atmospheric pressure or the internal pressure in the air cleaner is equal to the above particular value (e.g. 760 mmHg), or the intake air mass-based correction is interrupted, thus allowing the engine to continue its normal operation.

Since the A/D converter 42 is arranged to apply all of its output bits to the exclusive NOR gate $26_5$, the exclusive NOR gate $26_5$ generates an output "1" when all the output bits of the A/D converter 42 have a high level "1" (that is, $FF_{16}$) or a low level "0" (that is, $OO_{16}$), the above output "1" of the gate $26_5$ causing energization of the alarm lamp 61 as in the preceding examples.

Figure 7:
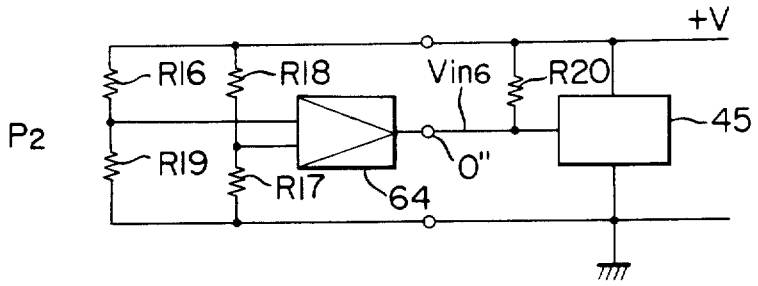
FIG. 7 is a circuit diagram illustrating details of the connection of the compressed air pressure (P2) shown in FIG. 1 with its associated parts.

FIG. 7 illustrates a concrete example of the connection of the silicon diaphragm-type P2 sensor 44. Symbols R16, R17 designate resistances mounted on the silicon diaphragm, not shown, of the P2 sensor 44 and adapted to have their resistance values variable as the silicon diaphragm becomes deformed (warped) with a change in the pressure P2. R18, R19 denote fixed resistances. As illustrated in FIG. 7, the resistances R16–R19 are arranged to form a bridge circuit which is connected to a differential amplifier 64 to apply its unbalance voltage thereto. A further fixed resistance R20 is connected between the positive voltage power source +V and the input of the A/D converter 45 and has its resistance value selected such that the input voltage to the A/D converter 45 has a value larger than any value falling within the normally variable output range of the P2 sensor.

As noted above, the unbalance output voltage of the bridge circuit R16–R19 is supplied to the differential amplifier 64 which in turn applies an output indicative of a detected P2 value to the A/D converter 45.

The output characteristic of the A/D converter 45 relative to the output of the P2 sensor 44 is set such that its digital output value does not become $OO_{16}$ or $FF_{16}$ so long as the output of the P2 sensor remains within its normally variable output range. In the event of occurrence of the following defects in the P2 sensor, the digital output of the A/D converter 45 becomes $OO_{16}$ or $FF_{16}$:

(1) In the event of a disconnection in the output line of the positive voltage power source +V, the input voltage $Vin_6$ drops to zero volt so that the digital output of the A/D converter 45 becomes $OO_{16}$;

(2) In the event of a disconnection in the earthing conductor, the input voltage $Vin_6$ rises above its normal variable range so that the digital output becomes $FF_{16}$;

(3) In the event of a disconnection in the input line (at point o'') to the A/D converter 45, the digital output becomes $FF_{16}$;

(4) In the event of a short between the input line to the A/D converter and the earthing conductor, the input voltage $Vin_6$ becomes zero volt so that the digital output becomes $OO_{16}$;

(5) In the event of a short between the input line to the A/D converter 45 and the positive voltage power source +V, the input voltage $Vin_6$ rises up to the supply voltage so that the digital output becomes $FF_{16}$.

The addresses in the memory 47 corresponding to the digital outputs $OO_{16}$ and $FF_{16}$ of the A/D converter 45 store a predetermined value $ra_3$ of the intake air mass-based correction coefficient ra which corresponds to a particular pressure (e.g. 760 mmHg) falling within the normally variable range of the P2 value during normal operation of the engine. The above predetermined coefficient value $ra_3$ may of course be set at 1. Therefore, in the event of trouble in the P2 sensor as mentioned above, fuel injection control is carried out which is similar to that available when the compressed pressure P2 is equal to the above particular pressure (e.g. 760 mmHg), or the intake air mass-based correction is interrupted, thus allowing the engine to continue its normal operation.

Since the A/D converter 45 is arranged to apply all of its output bits to the exclusive NOR gate $26_6$, the gate $26_6$ generates an output "1" when all the output bits of the A/D converter 45 have a high level "1" (that is, $FF_{16}$) or a low level "0" (that is, $OO_{16}$), the above output "1" of the gate $26_6$ causing energization of the alarm lamp 61 as in the preceding examples.

Figure 8:
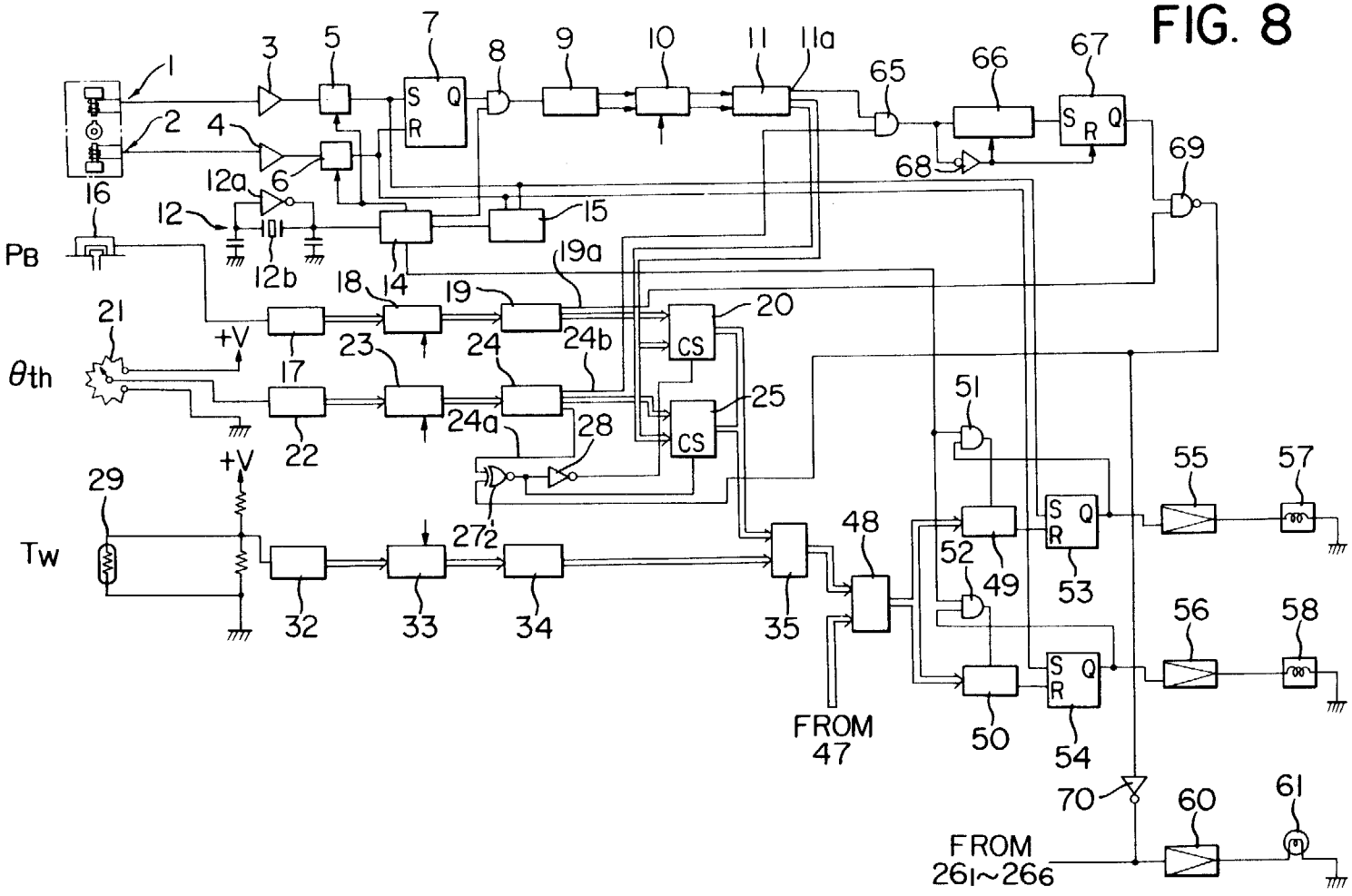
FIG. 8 is a block diagram illustrating a variation of the arrangement of FIG. 1.

FIG. 8 illustrates a variation of the embodiment of FIG. 1. In FIG. 8, an AND gate 65 has its one input terminal connected to an output terminal 11*a* of the memory 11, its other input terminal to an output terminal 24*b* of the memory 24, and its output terminal to a T-second counter 66, respectively. The T-second counter 66 has its output connected to the set pulse-input terminal S of a flip flop 67. An inverter 68 has its input connected to the output of the AND gate 65 and its output to the reset pulse-input terminal R of the flip flop 67, respectively. A NAND gate 69 has its one input terminal connected to the Q-output terminal of the flip flop 67 and its other input terminal to an output terminal 19*a* of the memory 19, respectively. The output terminal of the NAND gate 69 is connected to one input terminal of the exclusive NOR gate $27'_2$ and also connected to the amplifier 60 by way of an inverter 70. The illustrated component parts other than those mentioned above are arranged in the same manner as in FIG. 1, description of which is therefore omitted. Further, the sensors for detecting T1, P1, P2 and their related parts are also arranged in a similar manner to the FIG. 1 arrangement, illustration of which is therefore omitted.

The operation of the arrangement of FIG. 8 will now be described. According to this variation, a count indicative of a detected engine rpm Ne and latched in the latch 10 is converted into a 9-bit code by the memory 11. The MSB of the 9-bit code is outputted from the memory 11 through its output terminal 11*a*, which has a high level "1" when the detected Ne value is higher than a predetermined idle rpm, e.g., 1200 rpm. A digital value indicative of a detected intake pressure $P_B$ latched in the latch 18 is converted into a 9-bit code by the memory 19. The MSB of the 9-bit code has a high level "1" only when the intake pressure $P_B$ is equal to 760±20 mmHg, and is outputted from the memory 19 through its output terminal 19*a*. On the other hand, a digital latched value indicative of a detected θth value is also converted into a 9-bit code by the memory 24. Like the FIG. 1 arrangement, the 7 bits in the lower places of the 9-bit code are indicative of the detected θth value, and the MSB has a low level "0" when the detected θth value is less than the aforementioned predetermined value (that is, when the engine operates in a low load condition), and a high level "1" when the detected θth value is larger than the predetermined value, respectively. This MSB is outputted from the memory 24 through its output terminal 24*a*. The bit in the second highest place is outputted through the output terminal 24*b* of the memory 24, which takes a high level "1" when the detected θth value corresponds to an idle opening, e.g., approximately 1 degree, while taking a low level "0" when the detected θth value shows other values.

When the detected engine rpm Ne is higher than the aforementioned predetermined idle rpm (e.g. 1200 rpm) and simultaneously the throttle valve opening θth is nearly equal to the above predetermined idle opening (e.g. approximately 1 degree), the AND gate 65 generates an output "1" to trigger the counter 66 to start counting. When the generation of the output "1" form the AND gate 65 continues for a predetermined period of time T (e.g. 4 seconds), the counter 66 applies an output "1" to the set pulse-input terminal S of the flip flop 67 which in turn generates an output "1" at its Q-output terminal. If the output of the AND gate 65 turns "0" before the lapse of the above predetermined period of time T, the flip flop 67 is resetted by means of the inverter 68.

When the engine is in a low throttle valve opening region (but larger than approximately 1 degree), that is, in a low load region, the memory 24 generates an output "0" at its output terminal 24*a* as previously mentioned. At the same time, the AND gate 65 which has its one input terminal connected to the output terminal 24*b* of the memory 20 generates an output "0" so that the NAND gate 69 generates an output "1". Therefore, the exclusive NOR gate $27'_2$ generates an output "0". As a consequence, data Ti based upon the $P_B$-Ne map in the memory 20 is supplied to the multiplier 35, followed by corrections of the output data Ti by the correction coefficients rw, ra, respectively, at the multipliers 35, 48 and then energization of the solenoids 57, 58 based upon the corrected data Ti through the presettable counters 49, 50, the flip flops 53, 54, the amplifiers 55, 56, etc. in the same manner as mentioned with reference to FIG. 1.

On the other hand, when the engine operates in a high throttle valve opening region, that is, in a high load region, the output at the output terminal 24*a* of the memory 24 becomes "1", while simultaneously the output of the NAND gate 69 is "1". Therefore, the exclusive NOR gate $27'_2$ generates an output "1" to select data Ti based upon the θth-Ne map in the memory 25, followed by similar operations to that mentioned above.

Now, when the engine operates in a low load region, that is, the engine rpm Ne is higher than the predetermined idle rpm (e.g. 1200 rpm) and simultaneously the throttle valve opening θth is nearly equal to the predetermined idle opening (approximately 1 degree), high level outputs "1" are both generated at the output terminal 11*a* of the memory 11 and the output terminal 24*b* of the memory 24, and accordingly the counter formed by the AND gate 65, the T-second counter 66, the inverter 68 and the flip flop 67 starts counting. When this counting continues for the predetermined period of time T (e.g. 4 seconds), the flip flop 69 generates an output "1". On this occasion, if the intake pipe connected to the pressure sensor 16 which detects the intake pressure $P_B$ is put out of joint or gets loose, the pressure sensor 16 shows an output value close to atmospheric pressure (760±20 mmHg), though high negative pressure then prevails as intake pressure $P_B$ in the engine intake pipe, with the result that an output "1" is generated at the output terminal 19*a* of the memory 19. Consequently, the NAND gate 69 generates an output "0" so that the output of the exclusive NOR gate $27'_2$ becomes "1", which causes changeover from operation based upon the $P_B$-Ne map in the memory 20 to operation based upon the θth-Ne map in the memory 25. At the same time, the above output "0" of the NAND gate 69 is applied through the inverter 70 and the amplifier 60 to the alarm lamp 61 to energize the same.

According to the FIG. 8 arrangement described above, the disadvantage can be avoided that if in the event of an occurrence such as disclocation of the intake pipe of the $P_B$ sensor during low load operation of the engine (at idle throttle valve opening) fuel injection control operation based upon the $P_B$-Ne map is continued, a larger amount of fuel than required is injected into the engine, causing wetting of ignition plugs with injected fuel.

Figure 9:
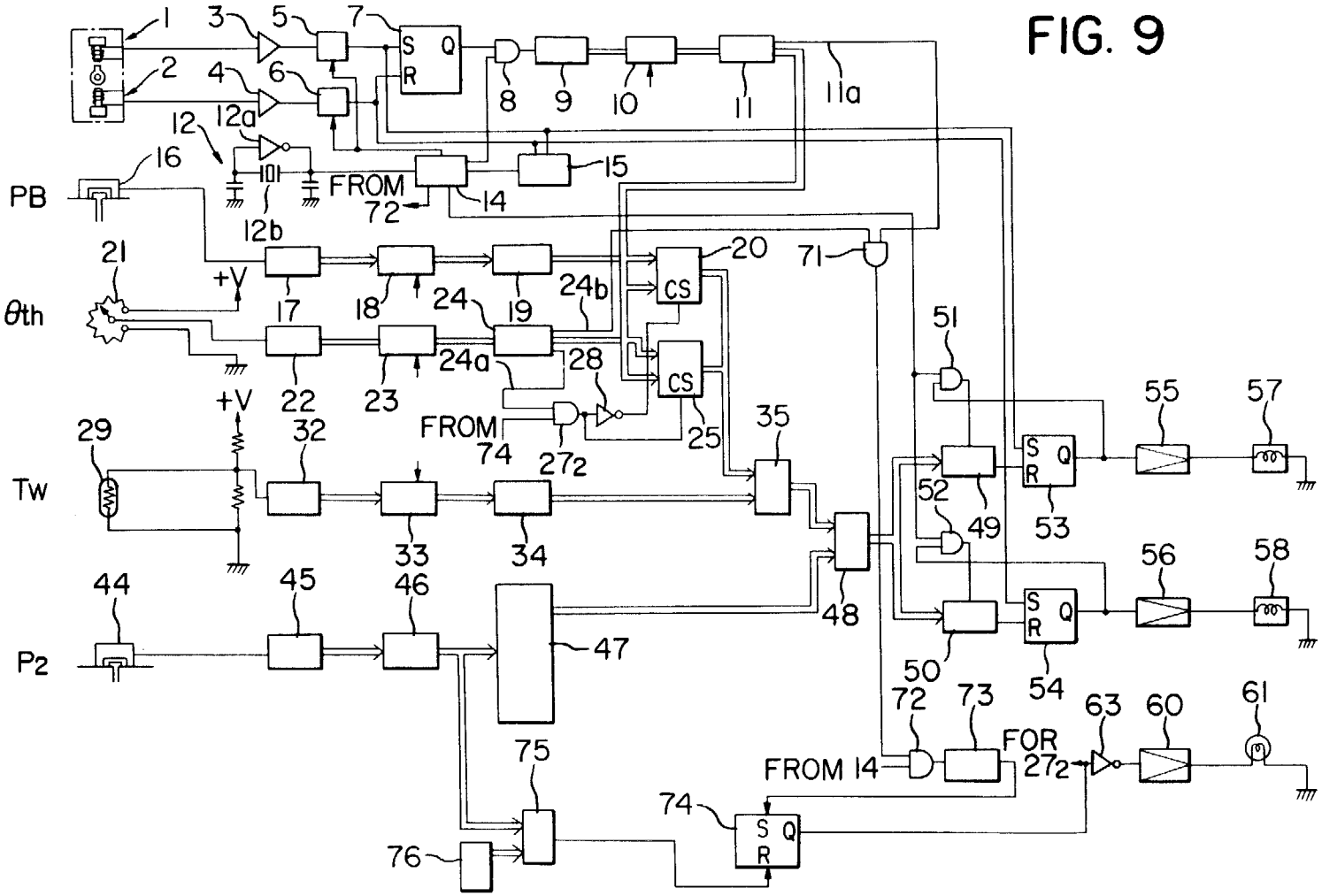
FIG. 9 is a block diagram illustrating a further variation of the arrangement of FIG. 1.

FIG. 9 illustrates another variation of the FIG. 1 embodiment. In FIG. 9, an AND gate 71 has its one input terminal connected to an output terminal 11*a* of the memory 11, its other input terminal to an output terminal 24*b* of the memory 24, and its output terminal to one input terminal of another AND gate 72, respectively. The AND gate 72 has its other input terminal connected to a clock pulse-output terminal of the frequency divider 14. The AND gate 72 has its output connected to the input of a counter 73 which in turn has its output connected to the set pulse-input terminal S of a flip flip 74 which is adapted to be reset with priority. The flip flop 74 has its reset pulse-input terminal R connected to the output of a comparator 75, and its Q-output terminal to the input of the AND gate $27_2$ directly and to the input of the solenoid-driving amplifier 60 by way of the inverter 63, respectively. The comparator 75 has its one input terminal connected to the output of the latch 46 and its other input terminal to the output of a code generator 76, respectively. The code generator 76 is adapted to generate a binary code signal, e.g. a 6-bit signal, indicative of a predetermined P2 value of 800 mmHg for instance. The comparator 75 is thus arranged to compare a digital 6-bit value indicative of a detected P2 value outputted from the latch 46 with a code signal indicative of the above predetermined value outputted from the code generator 76, and adapted to generate an output "1" when the former is smaller than the latter.

The illustrated component parts other than those mentioned above are arranged in the same manner as in the FIG. 1 arrangement, description of which is therefore omitted. Further, the sensors for detecting the values of T1, P1 and their related parts are also arranged in a manner similar to that in FIG. 1, illustration of which is therefore omitted.

The FIG. 9 arrangement operates as follows: According to this variation, the memory 11 is adapted to generate a binary output "1" at its output terminal 11*a* when the engine rpm Ne is higher than 4,000 rpm for instance. A latched digital value indicative of a detected θth value is converted into an 8-bit code by the memory 19 like the FIG. 1 arrangement. The 6 bits in the lower places of the 8-bit code represent the detected θth value, and the MSB has a high level "1" when the detected θth value is larger than the aforementioned predetermined value (that is, when the engine operates in a high load condition), and a low level "0" when the former is smaller than the latter, respectively, and is outputted from the memory 24 through its output terminal 24*a*. The bit in the second highest place becomes a high level "1" when the detected θth value is larger than half of the full throttle valve opening, and is outputted from the memory 24 through its output terminal 24*b*.

In the same manner as mentioned with reference to FIG. 1, the output at the output terminal 24*a* of the memory 24 becomes a low level "0" when the engine operates in a low throttle valve opening region, that is, in a low load condition, wherein the memory 20 is selected for carrying out fuel injection control based upon the $P_B$-Ne map, while in a high throttle valve opening or high load region, the output at the output terminal 24*a* of the memory 24 goes high to select the memory 25 for carrying out fuel injection control based upon the θth-Ne map.

Now, when the engine rpm Ne exceeds 4,000 rpm and simultaneously the throttle valve opening becomes larger than half of the full opening during the above high load operation, high level outputs "1" are both generated at the output terminal 11*a* of the memory 11 and the output terminal 24*b* of the memory 24, and accordingly the AND gate 71 outputs an output "1" to one input terminal of the AND gate 72 which then permits clock pulses applied to its other input terminal from the frequency divider 14 to pass therethrough and be applied to the counter 73 to cause the same to start counting. When the counting continues for 4 seconds for instance, the counter 73 outputs a carry signal "1" to the set pulse-input terminal S of the flip flop 74. On this occasion, if the intake pipe of the P2 sensor 44 which detects the compressed pressure P2 is put out of joint or gets loose so that pressure substantially equal to atmospheric pressure is inputted to the P1 sensor 44, which is less than the predetermined output value 800 mmHg of the code generator 76, the comparator 75 generates an output "1", resetting the flip flop 74. Accordingly, the flip flop 74 outputs a low level signal "0" to cause the AND gate $27_2$ to generate an output "0" so that the memory 20 is selected for carrying out fuel injection control based upon the $P_B$-Ne map. At the same time, the above outputs "0" of the flip flop 74 is inverted by the inverter 63 to energize the alarm lamp 61 through the amplifier 60.

According to the FIG. 9 arrangement described above, the disadvantage can be avoided that if in a high engine load condition an abnormality occurs such as dislocation of the intake pipe of the P2 sensor, the input pressure to the P2 sensor is substantially equal to atmospheric pressure despite higher pressure P2 than atmospheric pressure prevailing in the engine intake pipe so that a smaller amount of fuel than required is injected into the engine, resulting in the mixture supplied to the engine having an excessive air/fuel ratio, leading to deteriorated operation of the engine. That is, according to the FIG. 9 arrangement, in the above event, fuel injection control is carried out in response to intake pressure $P_B$ representative of actual engine condition, thus avoiding the above-mentioned disadvantage.

What is claimed is:

1. A fuel injection control system of the type electronically processing data indicative of a fuel quantity being injected into an internal combustion engine including an intake pipe and a throttle valve arranged in said intake pipe, in dependence upon parameters representative of operating condition of said engine, to obtain an electrical control signal corresponding to the value of processed data, and injecting a quantity of fuel determined by said electrical control signal into said engine, said system comprising: means for detecting a first parameter indicative of the rotational speed of said engine; means for detecting a second parameter indicative of the opening of said throttle valve; means for detecting a third parameter indicative of pressure in said intake pipe at a zone downstream of said throttle valve; means for detecting a fourth parameter indicative of the temperature of said engine; means for generating first data indicative of a basic fuel injection quantity, as a function of a combination of detected values of said first and second parameters; means for generating second data indicative of a basic fuel injection quantity, as a function of a combination of detected values of said first and third parameters; means for causing said second data generating means to generate said second basic fuel injection quantity data when an output value of said second parameter detecting means lies below a predetermined value, and causing said first data generating means to generate said first basic fuel injection quantity data when said output value lies above said predetermined value; means for generating a coefficient for correction of the value of said first or second basic fuel injection quantity data as a function of output of said fourth parameter detecting means; means for correcting the value of first or second basic fuel injection quantity data selectively generated by said first data generating means or said second data generating means, by an amount corresponding to a value of said correction coefficient generated by said correction coefficient generating means; means for generating said electrical control signal indicative of a desired fuel injection quantity corresponding to corrected data obtained by said correcting means; and means for setting the value of said correction coefficient to a value corresponding to a predetermined value of said fourth parameter which falls within a range within which the value of said fourth parameter can vary so long as said engine normally operates, when said fourth parameter detecting means generates an output value lying outside a range within which the output value of said fourth parameter detecting means can vary during normal operation of said engine.

2. A fuel injection control system of the type electronically processing data indicative of a fuel quantity being injected into an internal combustion engine including an intake pipe and a throttle valve arranged in said intake pipe, in dependence upon parameters representative of operating condition of said engine, to obtain an electrical control signal corresponding to the value of processed data, and injecting a quantity of fuel determined by said electrical control signal into said engine, said system comprising: means for detecting a first parameter indicative of the rotational speed of said engine; means for detecting a second parameter indicative of the opening of said throttle valve; means for detecting a third parameter indicative of pressure in said intake pipe at a zone downstream of said throttle valve; means for detecting a fourth parameter indicative of the temperature of said engine; means for detecting a firth parameter indicative of the mass of intake air being supplied to said engine; means for generating first data indicative of a basic fuel injection quantity as a function of a combination of detected values of said first and second parameters; means for generating second data indicative of a basic fuel injection quantity as a function of a combination of detected values of said first and third parameters; means for causing said second data generating means to generate said second basic fuel injection quantity data when an output value of said second parameter detecting means lies below a predetermined value, and causing said first data generating means to generate said first basic fuel injection quantity data when said output value lies above said predetermined value; means for generating a first coefficient for correction of the value of said first or second basic fuel injection quantity data as a function of output of said fourth parameter detecting means; means for generating a second coefficient for correction of the value of said first or second basic fuel injection quantity data as a function of output of said fifth parameter detecting means; means for correcting the value of first or second fuel injection data selectively generated by said first data generating means or said second data generating means, by an amount corresponding to a value of said first correction coefficient generated by said first correction coefficient generating means; means for correcting the value of said first or second basic fuel injection quantity data selectively generated, by an amount corresponding to a value of said second correction coefficient generated by said second correction coefficient generating means; means for generating said electrical control signal indicative of desired fuel injection quantity corresponding to corrected data obtained by said two correcting means; means for setting the value of said first correction coefficient to a value corresponding to a predetermined value of said fourth parameter which falls within a range within which the value of said fourth parameter can vary so long as said engine normally operates, when said fourth parameter detecting means generates an output value lying outside a range within which the output value of said fourth parameter detecting means can vary during normal operation of said engine; and means for setting the value of said second correction coefficient to a value corresponding to a predetermined value of said fifth parameter which falls within a range within which the value of said fifth parameter can vary so long as said engine normally operates, when said fifth parameter detecting means generates an output value lying outside a range within which the output value of said fifth parameter detecting means can vary during normal operation of said engine.

3. A fuel injection control system of the type electronically processing data indicative of a fuel quantity being injected into an internal combustion engine, in dependence upon parameters representative of operating condition of said engine to obtain an electrical control signal corresponding to the value of processed data, and injecting a quantity of fuel determined by said electrical control signal into said engine, said system comprising: means for detecting values of at least two first parameters indicative of the volume of intake air being supplied to said engine; means for detecting a value of at least one second parameter indicative of at least one other factor of operating condition of said engine; means for generating data indicative of a basic fuel injection quantity, as a function of output of said first parameter detecting means; means for generating at least one coefficient for correction of the value of said basic fuel injection quantity data, as a function of output of said second parameter detecting means; means for correcting the value of basic fuel injection quantity data generated by said data generating means; by an amount corresponding to the value of a correction coefficient generated by said correction coefficient generating means; means for generating said electrical control signal indicative of a desired fuel injection quantity corresponding to corrected data obtained by said correcting means; and means for setting the value of said at least one correction coefficient to a value corresponding to a predetermined value of said at least one second parameter which falls within a range within which the value of said at least one second parameter can vary so long as said engine normally operates, when said second parameter detecting means indicative of said at least one second parameter generates an output value lying outside a range within which the output value of said second parameter detecting means can vary during normal operation of said engine, wherein said correction coefficient generating means comprises a memory having a plurality of addresses respectively storing a plurality of different values of said correction coefficient corresponding respectively to different output values of said second parameter detecting means, and means for selecting an address corresponding to an output value of said second parameter detecting means, from said plurality of addresses, wherein said means for setting said correction coefficient to a value corresponding to said predetermined value of said second parameter comprises means providing addresses storing said value corresponding to said predetermined value of said second parameter in portions of an address space in said memory of said correction coefficient generating means which correspond respectively to output values of said second parameter detecting means which lie outside said variable output range thereof, and wherein said predetermined value storing addresses comprise two addresses located at opposite extreme ends of said address space, whereby when an output value of said second parameter detecting means lies above said variable output range of said second parameter detecting means, one of said two addresses is selected, and when the former lies below the latter, the other of said two addresses is selected.

4. A fuel injection control system of the type electronically processing data indicative of a fuel quantity being injected into an internal combustion engine, in dependence upon parameters representative of operating condition of said engine to obtain an electrical control signal corresponding to the value of processed data, and injecting a quantity of fuel determined by said electrical control signal into said engine, said system comprising: means for detecting values of at least two first parameters indicative of the volume of intake air being supplied to said engine; means for detecting a value of at least one second parameter indicative of at least one other factor of operating condition of said engine; means for generating data indicative of a basic fuel injection quantity, as a function of output of said first parameter detecting means; means for generating at least one coefficient for correction of the value of said basic fuel injection quantity data, as a function of output of said second parameter detecting means; means for correcting the value of basic fuel injection quantity data generated by said data generating means, by an amount corresponding to the value of a correction coefficient generated by said correction coefficient generating means; means for generating said electrical contorl signal indicative of a desired fuel injection quantity corresponding to corrected data obtained by said correcting means; and means for setting the value of said at least one correction coefficient to a value corresponding to a predetermined value of said at least one second parameter which falls within a range within which the value of said at least one second parameter can vary so long as said engine normally operates, when said second parameter detecting means indicative of said at least one second parameter generates an output value lying outside a range within which the output value of said second parameter detecting means can vary during normal operation of said engine, wherein said second parameter includes the temperature of said engine, wherein said correction coefficient generating means comprises a memory having a plurality of addresses respectively storing a plurality of different values of said correction coefficient corresponding respectively to different output values of said second parameter detecting means, and means for selecting an address corresponding to an output value of said second parameter detecting means, from said plurality of addresses, wherein said means for setting said correction coefficient to a value corresponding to said predetermined value of said second parameter comprises means providing addresses storing said value corresponding to said predetermined value of said second parameter in portions of an address space in said memory of said correction coefficient generating means which correspond respectively to output values of said second parameter detecting means which lie outside said variable output range thereof, wherein said predetermined value storing addresses comprise two addresses located at opposite extreme ends of said address space, whereby when an output value of said second parameter detecting means lies above said variable output range of said second parameter detecting means, one of said addresses is selected, and when the former lies below the latter, the other of said two addresses is selected, and wherein the fuel injection control system further includes alarm means actuatable in response to an output value of said second parameter detecting means lying outside said variable output range thereof.

5. A fuel injection control system of the type electronically processing data indicative of a fuel quantity being injected into an internal combustion engine, in dependence upon parameters representative of operating condition of said engine, to obtain an electrical control signal corresponding to the value of processed data, and injecting a quantity of fuel determined by said electrical control signal into said engine, said system comprising: means for detecting values of at least two first parameters indicative of the volume of intake air being supplied to said engine; means for detecting a second parameter indicative of the temperature of said engine; means for detecting a third parameter indicative of the mass of intake air being supplied to said engine; means for generating data indicative of a basic fuel injection quantity, as a function of output of said first parameter detecting means; means for generating a first coefficient for correction of the value of said basic fuel injection quantity data, as a function of output of said second parameter detecting means; means for generating a second coefficient for correction of the value of said basic fuel injection quantity data, as a function of output of said third parameter detecting means; means for correcting the value of basic fuel injection quantity data generated by said data generating means, by an amount corresponding to a value of said first correction coefficient generated by said first correction coefficient generating means; means for correcting the value of said basic fuel injection quantity data generated, by an amount corresponding to said value of said second correction coefficient generated; means for generating said electrical control signal indicative of a desired fuel injection quantity corresponding to corrected data obtained by said two correcting means; means for setting the value of said first correction coefficient to a value corresponding to a predetermined value of said second parameter which falls within a range within which the value of said second parameter can vary so long as said engine normally operates, when said second parameter detecting means generates an output value lying outside a range within which the output value of said second parameter detecting means can vary during normal operation of said engine; and means for setting the value of said second correction coefficient to a value corresponding to a predetermined value of said third parameter which falls within a range within which the value of said third parameter can vary so long as said engine normally operates, when said third parameter detecting means generates an output value lying outside a range within which the output value of said third parameter detecting means can vary during normal operation of said engine, wherein said second correction coefficient generating means comprises a memory having a plurality of addresses respectively storing a plurality of different values of said second correction coefficient corresponding respectively to different output values of said third parameter detecting means, and means for selecting an address corresponding to an output value of said third parameter detecting means, from said plurality of addresses, wherein said means for setting said second correction coefficient to a value corresponding to said predetermined value of said third parameter comprises means providing addresses storing said value corresponding to said predetermined value of said third parameter in portions of an address space in said memory of said second correction coefficient generating means which correspond respectively to output values of said third parameter detecting means which lie outside said variable output range thereof, and wherein said predetermined value storing addresses comprise two addresses located at opposite ends of said address space, whereby when an output value of said third parameter detecting means lies above said variable output range of said third parameter detecting means, one of said two addresses is selected, and when the former lies below the latter, the other of said two addresses is selected.

6. In a fuel injection control system of the type electronically processing data indicative of a fuel quantity being injected into an internal combustion engine, in dependence upon parameters representative of operating condition of said engine to obtain an electrical control signal corresponding to the value of processed data, and injecting a quantity of fuel determined by said electrical control signal into said engine, said system including: means for detecting values of at least one first parameter indicative of the volume of intake air being supplied to said engine; means for detecting a value of at least one second parameter indicative of at least one other factor of operating condition of said engine; means for generating data indicative of a basic fuel injection quantity, as a function of output of said first parameter detecting means; means for generating at least one coefficient for correction of the value of said basic fuel injection quantity data, as a function of output of said second parameter means for generating at least one coefficient for correction of the value of said basic fuel injection quantity data, as a function of out put of said second parameter detecting means; means for correcting the value of basic fuel injection quantity data generated by said data generating means, by an amount corresponding to the value of a correction coefficient generated by said correction coefficient generating means; and means for generating said electrical control signal indicative of a desired fuel injection quantity corresponding to corrected data obtained by said correcting means; the improvement wherein said second parameter detecting means comprises at least one sensor and related wiring thereof, and adapted to produce an output value variable within a first predetermined range corresponding to a range within which the value of said at least one second parameter can vary in response to operating conditions of said engine, when both said at least one sensor and said related wiring thereof are normally operative, and to produce an output value variable within a second predetermined range larger than said first predetermined range, when at least one of said at least one sensor and said related wiring thereof is abnormally operative, said system further comprising means for setting the value of said at least one correction coefficient to a value corresponding to a predetermined value of said at least one second parameter which falls within said first predetermined range, when said second parameter detecting means produces an output value falling outside said first predetermined range but within said second predetermined range.

7. In a fuel injection control system of the type electronically processing data indicative of a fuel quantity being injected into an internal combustion engine, in dependence upon parameters representative of operating condition of said engine, to obtain an electrical control signal corresponding to the value of processed data, and injecting a quantity of fuel determined by said electrical control signal into said engine, said system including: means for detecting values of at least two first parameters indicative of the volume of intake air being supplied to said engine; means for detecting a second parameter indicative of the temperature of said engine; means for detecting a third parameter indicative of the mass of intake air being supplied to said engine; means for generating data indicative of a basic fuel injection quantity, as a function of output of said first parameter detecting means; means for generating a first coefficient for correction of the value of said basic fuel injection quantity data, as a function of output of said second parameter detecting means; means for generating a second coefficient for correction of the value of said basic fuel injection quantity data, as a function of output of said third parameter detecting means; means for correcting the value of basic fuel injection quantity data generated by said data generating means, by an amount corresponding to a value of said first correction coefficient generated by said first correction coefficient generating means; means for correcting the value of said basic fuel injection quantity data generated, by an amount corresponding to said value of said second correction coefficient generated; and means for generating said electrical control signal indicative of a desired fuel injection quantity corresponding to corrected data obtained by said two correcting means; the improvement comprising means for setting the value of said first correction coefficient to a value corresponding to a predetermined value of said second parameter which falls wtihin a range within which the value of said second parameter can vary so long as said engine normally operates, when said second parameter detecting means generates an output value lying outside a range within which the output value of said second parameter detecting means can vary during normal operation of said engine; and means for setting the value of said second correction coefficient to a value corresponding to a predetermined value of said third parameter which falls within a range within which the value of said third parameter can vary so long as said engine normally operates, when said third parameter detecting means generates an output value lying outside a range within which the output value of said third parameter detecting means can vary during normal operation of said engine.

8. The fuel injection control system as claimed in claim 7, wherein said third parameter comprises the temperature of ambient atmospheric air and ambient atmospheric pressure.

9. The fuel injection control system as claimed in claim 7, wherein said engine includes an intake pipe, a throttle valve arranged in said intake pipe, and a turbocharger including a compressor arranged in said intake pipe at a zone upstream of said throttle valve, said third parameter comprising the temperature of ambient atmospheric air, ambient atmospheric pressure, and pressure in said intake pipe at a zone between said throttle valve and said compressor.

10. The fuel injection control system as claimed in claim 7, wherein said second correction coefficient generating means comprises a memory having a plurality of addresses respectively storing a plurality of different values of said second correction coefficient corresponding respectively to different output values of said third parameter detecting means, and means for selecting an address corresponding to an output value of said third parameter detecting means, from said plurality of addresses.

11. The fuel injection control system as claimed in claim 10, wherein said means for setting said second correction coefficient to a value corresponding to said predetermined value of said third parameter comprises means providing addresses storing said value corresponding to said predetermined value of said third parameter in portions of an address space in said memory of said second correction coefficient generating means which correspond respectively to output values of said third parameter detecting means which lie outside said variable output range thereof.

12. In a fuel injection control system of the type electronically processing data indicative of a fuel quantity being injected into an internal combustion engine, in dependence upon parameters representative of operating condition of said engine to obtain an electrical control signal corresponding to the value of processed data, and injecting a quantity of fuel determined by said electrical control signal into said engine, said system including: means for detecting values of at least two first parameters indicative of the volume of intake air being supplied to said engine; means for detecting a value of at least one second parameter indicative of at least one other factor of operating condition of said engine; means for generating data indicative of a basic fuel injection quantity, as a function of output of said first parameter detecting means; means for generating at least one coefficient for correction of the value of said basic fuel injection quantity data, as a function of output of said second parameter detecting means; means for correcting the value of basic fuel injection quantity data generated by said data generating means, by an amount corresponding to the value of a correction coefficient generated by said correction coefficient generating means; and means for generating said electrical control signal indicative of a desired fuel injection quantity corresponding to corrected data obtained by said correcting means; the improvement comprising means for setting the value of said at least one correction coefficient to a value corresponding to a predetermined value of said at least one second parameter which falls within a range within which the value of said at least one second parameter can vary so long as said engine normally operates, when said second parameter detecting means indicative of said at least one second parameter generates an output value lying outside a range within which the output value of said second parameter detecting means can vary during normal operation of said engine.

13. The fuel injection control system as claimed in claim 12, wherein said second parameter includes the temperature of said engine.

14. The fuel injection control system as claimed in claim 12, wherein said first parameter includes the rotational speed of said engine.

15. The fuel injection control system as claimed in claim 12, wherein said engine includes an intake pipe and a throttle valve arranged in said intake pipe, said first parameter including the opening of said throttle valve.

16. The fuel injection control system as claimed in claim 12, wherein said engine includes an intake pipe and a throttle valve arranged in said intake pipe, said first parameter including pressure in said intake pipe at a zone downstream of said throttle valve.

17. The fuel injection control system as claimed in claim 12, wherein said correction coefficient generating means comprises a memory having a plurality of addresses respectively storing a plurality of different values of said correction coefficient corresponding respectively to different output values of said second parameter detecting means, and means for selecting an address corresponding to an output value of said second parameter detecting means, from said plurality of addresses.

18. The fuel injection control system as claimed in claim 17, wherein said means for setting said correction coefficient to a value corresponding to said predetermined value of said second parameter comprises means providing addresses storing said value corresponding to said predetermined value of said second parameter in portions of an address space in said memory of said correction coefficient generating means which correspond respectively to output values of said second parameter detecting means which lie outside said variable output range thereof.

* * * * *